US008961111B2

(12) United States Patent
Benson et al.

(10) Patent No.: US 8,961,111 B2
(45) Date of Patent: Feb. 24, 2015

(54) TURBINE AND METHOD FOR SEPARATING PARTICULATES FROM A FLUID

(75) Inventors: Adebukola Oluwaseun Benson, Simponsville, SC (US); Gary Michael Itzel, Simpsonville, SC (US); Kevin Richard Kirtley, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 525 days.

(21) Appl. No.: 13/342,556

(22) Filed: Jan. 3, 2012

(65) Prior Publication Data

US 2013/0170982 A1 Jul. 4, 2013

(51) Int. Cl.
*F03B 11/08* (2006.01)
*F04D 29/70* (2006.01)

(52) U.S. Cl.
USPC ..... 415/121.2; 415/1; 415/169.1; 416/90 R

(58) Field of Classification Search
USPC ..... 415/121.2, 168.1, 168.4, 169.1, 115, 1; 416/90 R, 96 R, 97 R
See application file for complete search history.

(56) References Cited

U.S. PATENT DOCUMENTS

| | | | | |
|---|---|---|---|---|
| 3,309,567 | A | 3/1967 | Ehrich | |
| 3,338,049 | A | 8/1967 | Fernberger | |
| 3,362,155 | A | 1/1968 | Driscoll | |
| 4,685,942 | A | 8/1987 | Klassen et al. | |
| 7,695,243 | B2 * | 4/2010 | Lee et al. | 415/121.1 |

* cited by examiner

*Primary Examiner* — Edward Look
*Assistant Examiner* — Christopher J Hargitt
(74) *Attorney, Agent, or Firm* — Cantor Colburn LLP

(57) ABSTRACT

According to one aspect of the invention, a turbine airfoil includes a first cavity inside the turbine airfoil configured to receive a fluid and a second cavity inside the turbine airfoil. The turbine airfoil also includes a passage inside the turbine airfoil that provides fluid communication between the first and second cavities, wherein the passage includes a curved portion configured to separate particulates from the fluid as the fluid flows through the passage.

20 Claims, 1 Drawing Sheet

TURBINE AND METHOD FOR SEPARATING PARTICULATES FROM A FLUID

BACKGROUND OF THE INVENTION

The subject matter disclosed herein relates to turbine engines and, more particularly, to an apparatus and method for separating particulates from a fluid in turbine engines.

In a turbine, a combustor converts the chemical energy of a fuel or an air-fuel mixture into thermal energy. The thermal energy is conveyed by a fluid, often compressed air from a compressor, to a turbine where the thermal energy is converted to mechanical energy. As part of the conversion process, hot gas is flowed over and through portions of the turbine. High temperatures along the hot gas path can heat turbine components, causing degradation. A cooling fluid may flow through channels or cavities formed within the components to cool the components. In some cases the cooling fluid may include particulates, such as dust or dirt, which can build up in flow passages and disrupt flow. Reduced flow or restriction of the cooling fluid can lead to increased temperatures and thermal stress on turbine components.

BRIEF DESCRIPTION OF THE INVENTION

According to one aspect of the invention, a turbine airfoil includes a first cavity inside the turbine airfoil configured to receive a fluid and a second cavity inside the turbine airfoil. The turbine airfoil also includes a passage inside the turbine airfoil that provides fluid communication between the first and second cavities, wherein the passage includes a curved portion configured to separate particulates from the fluid as the fluid flows through the passage.

According to another aspect of the invention, a method for separating particulates from a fluid flowing within a turbine component includes receiving a fluid from a first cavity within the turbine component into a passage within the turbine component, wherein the passage includes a curved portion configured to separate particulates from the fluid as the fluid flows through the passage. The method also includes directing a clean fluid with a reduced amount of particulates from the passage to a second cavity within the turbine component.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
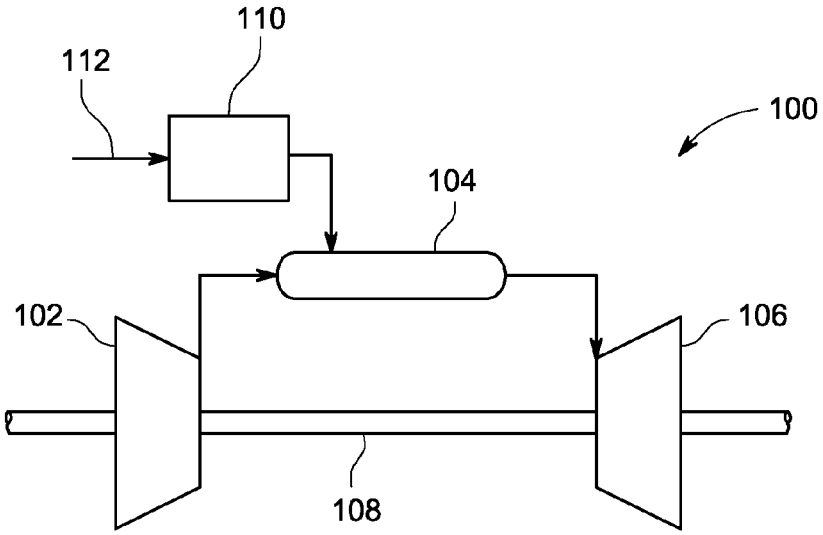
FIG. 1 is a schematic drawing of an embodiment of a gas turbine engine, including a combustor, fuel nozzle, compressor and turbine.

FIG. 1 is a schematic diagram of an embodiment of a gas turbine system 100. The system 100 includes a compressor

102, a combustor 104, a turbine 106, a shaft 108 and a fuel nozzle 110. In an embodiment, the system 100 may include a plurality of compressors 102, combustors 104, turbines 106, shafts 108 and fuel nozzles 110. The compressor 102 and turbine 106 are coupled by the shaft 108. The shaft 108 may be a single shaft or a plurality of shaft segments coupled together to form shaft 108.

In an aspect, the combustor 104 uses liquid and/or gas fuel, such as natural gas or a hydrogen rich synthetic gas, to run the engine. For example, fuel nozzles 110 are in fluid communication with an air supply and a fuel supply 112. The fuel nozzles 110 create an air-fuel mixture, and discharge the air-fuel mixture into the combustor 104, thereby causing a combustion that heats a pressurized gas. The combustor 104 directs the hot pressurized exhaust gas through a transition piece into a turbine nozzle (or "stage one nozzle") and then a turbine bucket, causing turbine 106 rotation. The rotation of turbine 106 causes the shaft 108 to rotate, thereby compressing the air as it flows into the compressor 102. As the firing temperature increases, the hot gas path components should be properly cooled to extend service life. In an embodiment, hot gas flows over and through portions of the gas turbine system 100, including the turbine 106. High temperatures along the hot gas path can heat components of the turbine 106, causing degradation. In one embodiment, a cooling fluid may flow through channels or cavities formed within the components to cool the components. In some cases the cooling fluid may include particulates, such as dust, ground metal dust, paint chips and chipped coatings, which can build up in flow passages and disrupt flow. Components with improved arrangements for removing particulates from a flow of cooling fluid and methods for using such components are discussed in detail below with reference to FIG. 2.

As used herein, "downstream" and "upstream" are terms that indicate a direction relative to the flow of working fluid through the turbine. As such, the term "downstream" refers to a direction that generally corresponds to the direction of the flow of working fluid, and the term "upstream" generally refers to the direction that is opposite of the direction of flow of working fluid. The term "radial" refers to movement or position perpendicular to an axis or center line. It may be useful to describe parts that are at differing radial positions with regard to an axis. In this case, if a first component resides closer to the axis than a second component, it may be stated herein that the first component is "radially inward" of the second component. If, on the other hand, the first component resides further from the axis than the second component, it may be stated herein that the first component is "radially outward" or "outboard" of the second component. The term "axial" refers to movement or position parallel to an axis. Finally, the term "circumferential" refers to movement or position around an axis. Although the following discussion primarily focuses on gas turbines, the concepts discussed are not limited to gas turbines and may apply to other rotating machinery, including steam turbines.

Figure 2:
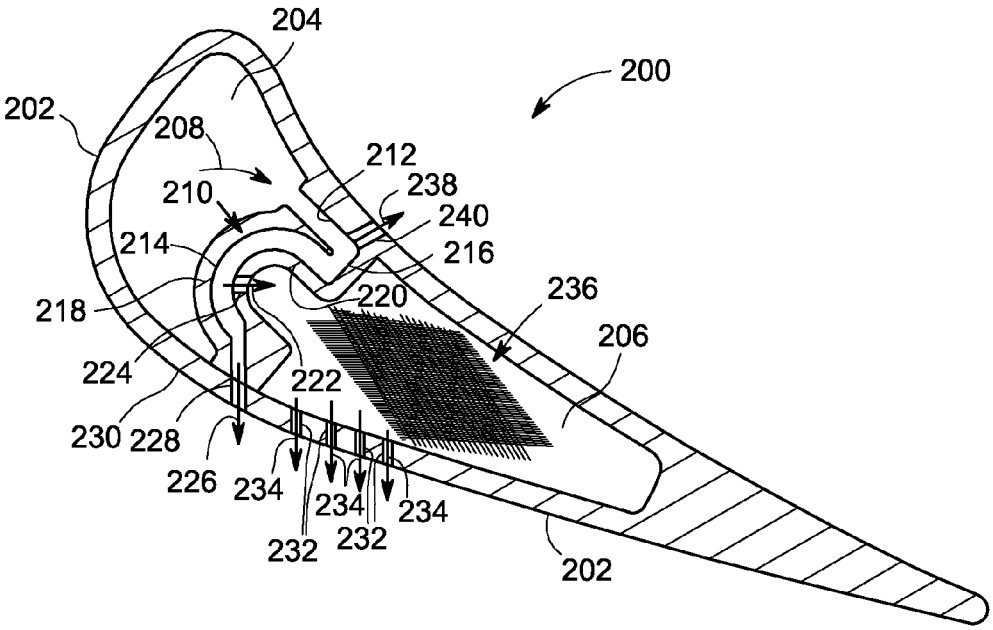
FIG. 2 is a top section view of an exemplary airfoil.

FIG. 2 is a sectional top view of an embodiment of a turbine component, such as an airfoil 200. The airfoil 200 includes an outer wall 202 containing a leading edge (LE) cavity 204 and a trailing edge (TE) cavity 206, wherein the cavities are configured to receive a fluid to control the temperature of portions of the airfoil 200. In an embodiment, the LE cavity 204 receives a fluid 208, such as air, used to cool portions of the airfoil 200. A passage 210 receives the fluid 208 and separates particulates from the fluid 208 as it flows through the passage 210. The passage 210 includes a substantially straight portion 212 and a substantially curved portion 214, wherein a hairpin portion 216 connects the substantially straight portion 212 to the substantially curved portion 214. As the fluid 208 flows through the curved portion 214, a centrifugal force acts on the flowing fluid 208 to cause or urge particulates to flow toward a radially outer wall 218 of the curved portion 214, due to the higher mass of the particulates relative to the fluid. Accordingly, the fluid 208 proximate a radially inner wall 220 has a reduced amount of particulates. In an embodiment, a clean fluid 222 comprising the fluid 208 with a reduced amount of particulates proximate the radially inner wall 220 flows through a passage 224 in the radially inner wall 220. The remaining fluid 208 includes an increased amount of particulates and forms a fluid 226 (also referred to as "remaining fluid") that flows through a passage 228 in the outer wall 202 proximate an end or downstream portion of the passage 210. In an embodiment, the fluid 226 flows through the passage 228 and forms a film that cools a surface 230 of the outer wall 202.

The TE cavity 206 receives the clean fluid 222 with a reduced amount of particulates, wherein the clean fluid 222 is directed to other locations, such as passages, channels and/or other cavities for controlling temperature within the airfoil 200. As depicted, passages 232 in the outer wall 202 enable clean fluid 234 to flow from the TE cavity 206, wherein the clean fluid 234 cools the outer wall proximate the passages 232. The reduced amount of particulates in the clean fluid 234 enables fluid flow through channels or passages, such as passages 232, without particulate buildup that can restrict fluid flow. In an embodiment, the passages 232 are small diameter cooling passages. Small diameter cooling passages (e.g., passages 232) provide enhanced control of cooling for selected portions of turbine parts and, thus, are susceptible to blockage. Accordingly, by reducing buildup of particulates in the fluid flowing through the flow channels and passages, enhanced control of turbine part temperatures is provided to prevent thermal fatigue, wear and/or damage.

In embodiments, a porous material, such as metal foam 236, may receive the clean fluid 222, wherein pores in the foam are fluid flow passages for cooling portions of the airfoil 200. The connected pore passages of the metal foam 236 allow clean fluid 222, such as cooling air, to fill at least part of the TE cavity 206 and thus increase the surface area for the cooling air to flow over. The reduced particulates in clean fluid 222 reduce blockage of pore passages in the metal foam 236, therefore improve cooling. In an embodiment, the passage 210 includes a passage 240 in outer wall 202 proximate the hairpin portion 216, wherein a flow of fluid 238 includes an increased amount of particulates. Thus, the turn in flow of fluid 208 and accompanying centrifugal forces cause separation of at least a portion of the particulates to provide a reduced amount of particulates in the fluid 208 used for cooling.

It should be noted that the depicted arrangement of the passage 210 in the airfoil 200 may be used to separate higher mass material, such as particulates, from a fluid inside any suitable turbine components including, but not limited to, airfoils, shrouds and bulkheads. Further, the passage 210 with the substantially curved portion 214 may be located in any suitable location within the turbine component, wherein the passage receives the fluid with particulates and separates the particulates by centrifugal force and the clean fluid 222 flows to another location for further component cooling. A hairpin passage includes a flow path with a very acute inner angle turn, making a substantial amount of the fluid flow turn almost 180° to continue flow along the passage. A curved passage fluid to flow in a substantially curved path that also causes a centrifugal force to urge higher mass material to a radially outer wall of the passage. Examples of the curve passage geometry include an arc, half circle and a plurality of straight portions with small angles between them (forming a substantially arc-shaped curve flow path). The depicted passage 210 in the component may be in fluid communication with cavities, channels or passages located within or outside the turbine component, wherein the passage 210 is configured to reduce the amount of particulates within the fluid 208 and provide the clean fluid 222 to the second cavity (i.e., TE cavity 206).

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A turbine airfoil comprising:

a first cavity inside the turbine airfoil configured to receive a fluid;

a second cavity inside the turbine airfoil; and a passage extending through the turbine airfoil from a pressure side surface to a suction side surface, the passage providing fluid communication between the first and second cavities, wherein the passage includes a straight portion, a curved portion, and a hairpin portion arranged between the straight portion and the curved portion, the passage being configured to separate particulates from the fluid as the fluid flows through the passage.

2. The turbine airfoil of claim 1, wherein the passage separates the particulates from the fluid to provide a clean fluid with a reduced amount of particulates to the second cavity.

3. The turbine airfoil of claim 2, wherein the clean fluid is directed into the second cavity through a passage in a radially inner wall of the curved portion.

4. The turbine airfoil of claim 2, wherein the particulates are directed outside the airfoil through a passage proximate a downstream portion of the curved portion.

5. The turbine airfoil of claim 2, wherein the clean fluid is directed through passages in a wall of the turbine airfoil to control a temperature of the turbine airfoil.

6. The turbine airfoil of claim 1, wherein the fluid without the particulates after separation comprises a remaining fluid directed to an outer portion of the turbine airfoil to provide film cooling.

7. The turbine airfoil of claim 1, wherein the fluid comprises air and the particulates comprise dust.

8. The turbine airfoil of claim 1, wherein a centrifugal force caused by flow of the fluid through the curved portion urges the particulates towards a radially outer wall of the curved portion as the fluid flows through the passage.

9. A method for separating particulates from a fluid flowing within a turbine component, the method comprising:

receiving a fluid from a first cavity within the turbine component into a passage extending through the turbine component from a pressure side surface to a suction side surface, the passage providing, wherein the passage causes the fluid to flow through a straight portion, a curved portion and a hairpin portion arranged between the straight portion and the curved portion to separate particulates from the fluid as the fluid flows through the passage; and directing a clean fluid with a reduced amount of particulates from the passage to a second cavity within the turbine component.

10. The method of claim 9, wherein directing the clean fluid comprises directing the clean fluid into the second cavity through a passage in a radially inner wall of the passage.

11. The method of claim 9, comprising directing a remaining fluid including separated particulates outside the component through a passage proximate a downstream portion of the passage.

12. The method of claim 9, comprising directing the clean fluid through small passages in a wall of the second cavity to control a temperature of the component.

13. The method of claim 9, wherein receiving the fluid comprises receiving air and wherein the particulates comprise dust.

14. The method of claim 9, wherein receiving the fluid from the first cavity comprises urging the particulates to flow towards a radially outer wall of the passage via a centrifugal force caused by flow of the fluid through the passage.

15. A turbine comprising:

a compressor;

a combustor; and a component in the turbine, the component comprising a passage extending from a pressure side surface to a suction side surface, the passage providing fluid communication between first and second cavities in the turbine, wherein the passage includes a straight portion, a curved portion, and a hairpin portion arranged between the straight portion and the curved portion, the passage being configured to separate particulates from the fluid as the fluid flows through the passage to provide a clean fluid with a reduced amount of particulates that is received by the second cavity.

16. The turbine of claim 15, wherein the component comprises a passage in a radially inner wall of the curved portion configured to direct the clean fluid from the passage into the second cavity.

17. The turbine of claim 15, wherein the component comprises a passage proximate a downstream portion of the curved portion configured to direct the particulates outside the component.

18. The turbine of claim 15, comprising small passages in a wall of the second cavity configured to direct the clean fluid outside the component to control a temperature of the component.

19. The turbine of claim 15, wherein the fluid comprises air and the particulates comprise at least one of dust, ground metal dust, paint chips and chipped coatings.

20. The turbine of claim 15, wherein a centrifugal force caused by flow of the fluid through the curved portion causes the particulates to flow towards a radially outer wall of the curved portion as the fluid flows through the passage.

* * * * *